United States Patent [19]

Niemi

[11] Patent Number: 5,011,573

[45] Date of Patent: Apr. 30, 1991

[54] METHOD AND APPARATUS FOR CONTROL OF DRY-LINE ON THE WIRE OF A FOURDRINIER PAPER MACHINE

[75] Inventor: Antti J. Niemi, Yrjo Liipolantie 5, SF-02700 Kauniainen, Finland

[73] Assignees: Antti Johannes Niemi; Ulli Riitta Annelli Niemi, both of Kauniainen, Finland

[21] Appl. No.: 377,852

[22] PCT Filed: Dec. 30, 1987

[86] PCT. No.: PCT/FI87/00180

§ 371 Date: Aug. 15, 1989

§ 102(e) Date: Aug. 15, 1989

[87] PCT Pub. No.: WO88/05099

PCT Pub. Date: Jul. 14, 1988

[30] Foreign Application Priority Data

Dec. 30, 1986 [FI] Finland ..... 865329

[51] Int. Cl.[5] ..... D21F 7/06

[52] U.S. Cl. ..... 162/198; 162/259; 162/263; 364/471; 358/107

[58] Field of Search ..... 162/198, 252, 253, 258, 162/259, 262, 263; 364/471; 358/107

[56] References Cited

U.S. PATENT DOCUMENTS 3,926,719 12/1975 Spitz ..... 167/253
4,500,968 2/1985 Bialkowski ..... 162/252

FOREIGN PATENT DOCUMENTS 1360992 7/1974 United Kingdom .
1430420 3/1976 United Kingdom .

*Primary Examiner*—Karen M. Hastings
*Attorney, Agent, or Firm*—Felfe & Lynch

[57] ABSTRACT

The method and apparatus automate the observation of the dry line on the wire of the Fourdrinier paper machine on whose visual observation by eye the conventional control of the paper machine is based. In the invention, the position of the dry line and its such values which deviate from normal, and the quantities which express its form, are reproduced to the operator repeatedly. In order to carry out this, it is formed as one essential feature of the invention, the image of the plane of the wire with an opto-electric camera and the electric, discrete image information is transmitted into a computer. While the conventional observation of the dry line is based on reflections from the pulp surface which are brighter than the other surface, these, however, disturb an instrumental observation and check an interpretation of the result of observation. These drawbacks are eliminated by the second essential feature of the invention which is the illumination of the wire in the manner presented, so that direct reflections from the pulp surface to the camera do not occur and on the contrary, the pulp surface is observed and found darker than the web surface following it whereby the dry line is observed and intepreted as the borderline between surfaces of an essentially uniform brightness each. The system may be, further on, applied to control, by feedback, the actuating variables which have an effect on the dry line, especially the headbox lip.

8 Claims, 2 Drawing Sheets

METHOD AND APPARATUS FOR CONTROL OF DRY-LINE ON THE WIRE OF A FOURDRINIER PAPER MACHINE

When paper is made in a Fourdrinier paper machine having a plain wire, the slush pulp is fed on the wire on which it settles as a layer. Main part of the water content of the pulp is removed through the holes in the wire. At first the water is removed by the gravity and later on by suction produced under the wire. The water content of the pulp is typically 99% at the beginning and 80–85% at the end of the wire. The moisture is further removed in the drying section of the machine which produces the final paper. This final moisture depends on operation of the various parts of the machine and one essential quantity that affects the same is the moisture of pulp web at the end of wire.

Particularly the homogenity of the quality of the paper is affected by the change of moisture both as a function of time and accross the web. Meters based on various principles have been developed in order to determine, at the end of the paper web, the moisture and its average change as a function of time, and also the moisture profile accross the web. These devices are usually based on absorption of infrared radiation or on a corresponding phenomenon. Similar meters are also used for determination of the basis weight of the paper at the dry end. They are based e.g. on absorption of infrared or nuclear radiation.

The obtained, measured signals are further also used for feedback control of the measured quantities, the mean values of the moisture and basis weight being influenced e.g. by controlling the pressure of the headbox and the thermal effect of the drying section. Correspondingly, the transversal profile is influenced by controlling the headbox lip with the lip screws. Each one of these is controlled separately by hand; in some cases nowadays also automatically.

Correction of the moisture profile in the drying section is difficult and requires extra energy, if e.g. an excessively dried web must be remoistened at some locations. Therefore it is important to reach as homogeneous moisture as possible in the transversal direction, at the end of the wire. Further on, this value of the moisture must be correct so that the removal of water is correctly divided between the wire and the drying sections.

The moisture of the pulp web is manifested by the dry line present on the wire. As the pulp settles on the wire and water is removed therefrom, fibers accumulate at first in the lower part of the pulp layer, next to the wire. The upper part is kept dilute and resembles closely water for its properties. This dilute pulp layer disappears later, as water is removed therefrom through the pulp layer collected under it and through the wire. The borderline corresponding to the disappearance of the dilute layer can be seen at some locations because of the light reflected by the surface of the layer. In text- and handbooks this is stated as the gloss of the surface (see e.g. Suomen Paperi-insinöörien Yhdistyksen oppija käsikirja III:1 "Paperin valmistus" 1983 p. 569). The position of the dry line is to some degree also affected by the amount of wood fibers and their distribution on the wire. However, the main actor is the water and its distribution.

The dry line is usually not such a straight line and perpendicular to the longitudinal direction of the wire, as it should be in an ideal case. Its position depends on the transversal coordinate and furthermore it usually changes with the time, at least slowly. Individual spikes which express corresponding peaks of moisture are typical. Since the dryline can at some locations be observed with the naked eye, the machine tenders base their actions, especially the adjustment of the lip, on these observations. The advantage of such a control procedure is its speed. Since one does not wait for measured data from the dry end of the machine, one does not loose the dead time implied by the drying section which is at least several tens of seconds in magnitude. If one wants, on the other hand, to take a benefit of the speed reached by the stated procedure, at least one worker is continuously bound by this duty which is trying to his perceptive faculty.

At any rate, the visual observation of the man is subjective. He certainly observes the local, relative differences of position of the dry line, but he is unsuccessful in observation of the dry line as an entity and in observation of temporal differences, i.e. in comparison with earlier positions and forms of the dry line, and the same applies also with regard to the average position of the dry line and to its change in the longitudinal direction of the wire.

A new method is presented in the following by which the dry line of the wire is measured continuously and objectively, independently of the observation made by a man. The measured results are exhibited perspicuously, in the form of quantities representing the average position of the dry line and its distribution in longitudinal and transversal directions. The results are also communicated as functions of time, i.e. a comparison with results measured earlier is made automatically.

The method has a great significance to the control of the paper machine and especially to that of the moisture of the paper. It can be materialized by an apparatus which can be assembled from commercially obtainable components, and by programming the computer which belongs to the hardware system using known programming methods. The hardware system can, furthermore, be engaged to control automatically the actuators of the paper machine, especially the mechanisms which act on the lip, but also, e.g. On the pressure of the headbox.

Figure 1:
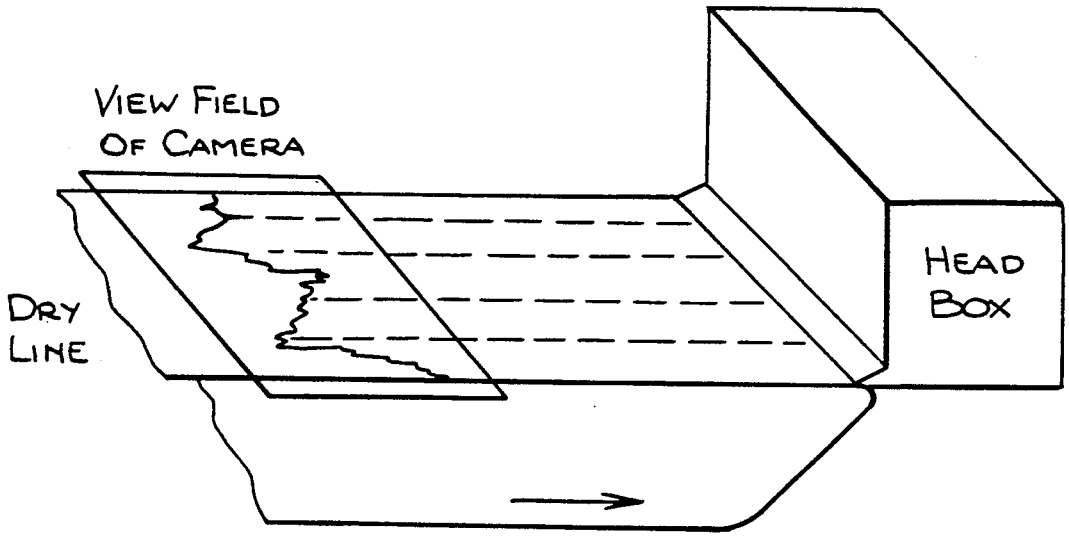
FIG. 1 is a fragmentary diagrammatic, perspective view of the wire section of the paper machine, the dry line and the field of view of an electro-optical camera.

One essential feature of the invented method is the formation of the image of the plane of the wire and of that of the material on the wire, by means of an optoelectric camera (FIG. 1), the transfer of the image information to a digital computer and processing therein in order to detect the dry line and to determine the quantities which characterize it. This feature which, when combined in a new manner with the other features, forms the invention, represents a technology known as such which may be based on the use of a conventional TV camera or on the use of electric signals which consist of solely discrete elements and on the use of electronic devices which are composed of discrete components, some of which have presented e.g. in the GB patent No. 1,430,420.

The stated method as such does not, however, lead to a clear and correct image of the dry line and also not to the correct values of the quantities characterizing it. This is due to the facts which are known even from the visual observation made by the man and which mislead an instrumental observation. The gloss of the surface of water observed at the inspection of the wire is namely not uniform, but consists of spots which are brighter than their environment, transmitting light to the eyes of the observer by reflection from various sources of light, like from the lamps of the factory hall. A spot corresponding to even a single source of light is then indefinite and dispersed since, because the water surface of the pulp above the moving wire and fiber layer is not very plane and its local inclination is variable, what is observable to the eye is not a simple mirror image of the light source in question, but a nonuniform, glittering area which has an indefinite borderline and within which dark areas and correspondingly outside which separate, glittering areas are exhibited. The glittering areas of the pulp surface at places extend, at other places do not extend down to the dry line. The water surface of the pulp often forms narrow, long peaks and their observation is rendered particularly difficult by the unevenness of the gloss.

As the wire is met by light from several light sources, or as the light power is increased, the stated difficulties are not decreased at all. On the contrary, the number of separate glittering areas and levels of brightness is then increased which further hampers the observation. In order to form a picture of the dry line, the machine tender therefore has to move, in order to inspect it from different directions. The automatic observation of the dry line thus turns out to be difficult to the technologies of measurement. Its determination by means of a computer on the basis of an indefinite camera signal is a hard programming task which would lead to time consuming computations, if it could be carried out at all.

The second essential feature of the invention is the observation of the wire in such a manner that the disturbing phenomena stated above are avoided. This is accomplished by carrying out the observation of the area covered by the pulp in such a manner that it is detected and found less bright or darker than the web surface after the dry line, i.e. contrarywise to the conventional manner of observation. This is established by carrying out the illumination of the wire and the location of the electro-optical camera in the manner to be disclosed in the following. It has been proved by experiments, that the method results in a clear and reliable, automatic detection of the dry line.

Figure 2:
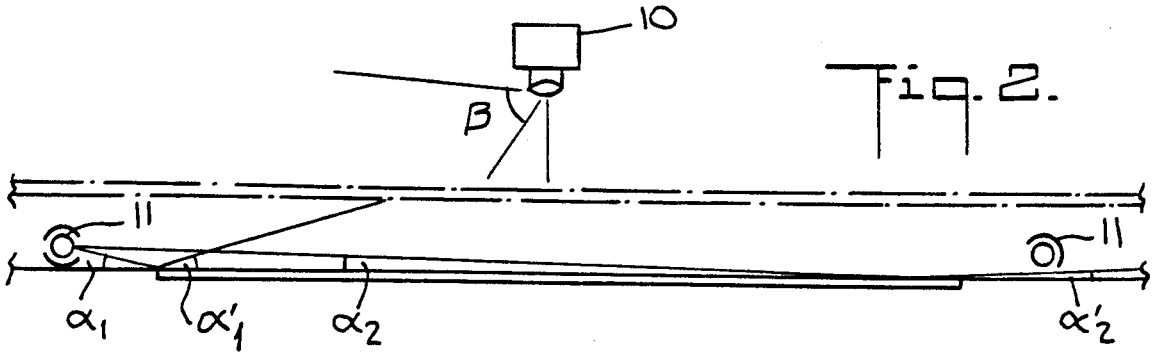
FIG. 2 is a fragmentary, elevational, diagrammatic view of the illumination of the wire and the camera installed above it.

In the method, the wire is illuminated for its whole width in a small angle with regard to its plane and observed by an electrooptical camera 10 whose optical axis differs strongly from the main direction of refection, at the same time as the arrival of disturbing light from other light sources is prohibited. In the embodiment according to FIG. 2 the light emitted by a tubular illuminator 11 meets the horizontal plane of the surface of material in a small angle of a magnitude between the angles $\alpha_1$ and $\alpha_2$. Because the pulp surface is inclined at places, the reflected light leaves the surface in an angle which may be greater than the former and smaller than the latter angle, i.e. in the range of $\alpha_1 ... \alpha_2$. Even these extrema, in the first place $\alpha_1$, are far from the angle $\beta$, while the light should be reflected in an angle greater than this $\beta$ in order to hit the camera, if this has been installed centrally above the wire, in the manner shown by FIG. 2.

The illuminators 11 are preferably tubular, so that the wire can be illuminated by them for the desired length, while they are installed in line at both sides of the wire as needed, outside it, and even at its ends, if required. A direct radiation from them to the camera is prevented by means of shades. Such other light sources and the windows of the factory hail which may disturb the observation through the light therefrom which would hit the camera either directly or by reflection from the pulp surface, are likewise provided with shades preventing the radiation in the directions in question. Due to these arrangements, no bright spots caused by reflections will be present in the field of view of the camera.

Figure 3:
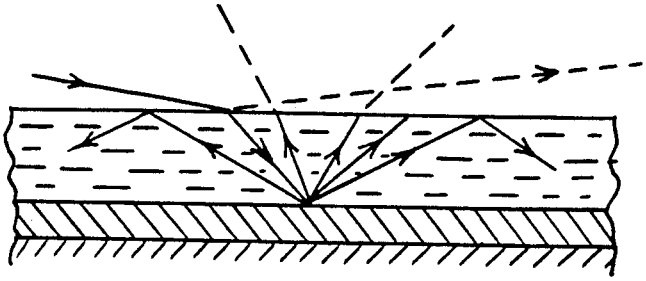
FIG. 3 is a fragmentary, sectional, diagrammatic view of the propagation of the light in the pulp.

The smaller the angle of arrival of the light, the greater part of the light which meets the pulp is reflected (FIG. 3). This part approaches 100%, as the angle approaches zero. The other part is refracted at the surface of the pulp which behaves like water. In the pulp layer, this light is scattered in all directions by single fibers and the dispersively reflecting fiber layer which has already been formed on the surface of the wire. At the same time, its power is decreased by absorption. That part of the light which, after scattering and reflection, returns to the surface, depart therethrough if the return angle is 41, 4°....90° with regard to the plane of surface. The greater the return angle, the greater part of the light arriving in this range of the angle is refracted at the surface into the total half-space above the surface, while the other part is reflected from the surface back to the pulp. All the light which returns in a smaller angle of 0°... 41, 4° is totally reflected from the surface and continues further its course within the pulp.

After the pulp layer has disappeared, behind the dry line, the light from the illuminator meets a web above which no free water is present. No mirror reflection is then present, but the web surface reflects dispersively into the total halfspace above it either all the light, if the coefficient of reflection of the mass is 1, or a correspondingly smaller part of it, if the coefficient is smaller. The coefficient can be considered the same both for the dispersive reflection which takes place directly from the surface of mass and for that taking place below the pulp layer as described in the previous paragraph.

Summarizing the above, one may conclude that the half-space above the wire receives less light from the pulp preceding the dry line than from the mass at the latter side of it. The difference is caused by the light which departs due to the mirror reflection and by that part of the light which is absorbed during its course in the pulp and the intermittent total reflections. Correspondingly, the camera receives less light from the part preceding the dry line than from the part following it. In the illumination and imaging method described, the previous part of the wire is thus found darker than the latter part, while neither part causes such refections which would disturb the observation.

Since the parts preceding and following the dry line thus have different luminosities, if they are observed from a sufficiently great angle, a camera installed above also distinguishes them from each other whereby also their borderline, i.e. dry line is observed. It has been proved by tests that this distinction and observation are made easily and clearly and no disturbing mirror refections nor shadows are found on the wire. When the illuminators have been installed at the sides of the wire, the luminosity decreases somewhat from the side towards the centre of the wire, even if the illuminators have been provided with reflectors installed behind them, but the change is smooth and rather insignificant and does not cause essential difficulty to observation and distinction.

The camera is installed so that its optics form a real image of the wire on its electronic detecting surface which may be a continuous surface like in the conventional TV camera tube, or consist of discrete elements like in semi-conductor cameras. The detector transforms the optical image information into electric form and this electric information is read repeatedly, at short intervals as an electric signal. The signal is transferred into a computer which has been provided with facilities for its repeated reception. Depending on the choice of the components one may then have to use additional elements, like analog-to-digital converter for discretization of analog signals, or preprocessors with fixed programming or wiring in order to speed up the processing of the signals. These may be united with either the camera or the computer.

The technology needed for all of these operations is previously known and can be carried out by means of components which are commercially available.

The light and dark areas of the wire have to be distinguished from each other in the method. Therefore the power of illumination and the setting of the iris of camera are chosen in such a manner that the areas in question can be distinguished by the detector. In addition to this, the electric signal is thresholded in connection with the transfer so that those signal elements which exceed and those which pass below the threshold which has been given as an electric value, are clearly distinguished from each other. The height of the threshold is set by the user of the apparatus, but it may also be programmed to set itself automatically after a corresponding tuning, e.g. according to changes of the general level of luminosity. Several thresholds may be present; also they and their use represent previously known technology.

As the image signals arrive into the computer, they may be either processed immediately or stored in the memory or both processed and stored. With previously known programs, the signal can also be reproduced immediately e.g. on a display terminal, whereby the dry line is represented by the border between surfaces composed of characters which correspond to dark and light image elements (e.g. 0/1 or W/.). Alternatively, one may determine the readings "0" which exceed a given highest position coordinate and the readings "1" which remain short of a given smallest position coordinate, and their coordinates of location in the transversal direction. By computing the amounts and moments of the elements 0 or 1, the position and variance of the median and mean value of the dry line are further determined.

The dry line can also be expressed e.g. by the broken line function which passes the remotest 0-elements. The line of regression which best approximates the dry line expresses its average inclination. Furthermore, a cureve of 2nd order can be fitted to the function, in order to express its average curvature, and functions of a higher order or trigonometric functions can be fitted, when one wants to indicate a periodicity which is possibly present in the dry line. All of these tasks represent a known technology which has been described in the literature on image analysis and which can be implemented with computers of normal structure. The corresponding programs can be easily established and applied to the task required by the invention by a person who is familiar with automatic data processing.

The machine tender does not always in practice need to control the dry line continuously. Correspondingly, it is practical to provide the computer with a voice or light signalling device which launches an alarm, if one of the above quantitatives exceeds a given limit. Often the required signalling device belongs to the computer as a standard outfit. Storage of data on paper or in mass memory may partly depend on the alarms, while the interesting quantities are stored even otherwise by the programs at fixed intervals.

The machine tender or the operating personnel of the paper machine controls its operation by adjusting its actuators and control devices and the set value adjusters of automatic control devices connected thereto. This control traditionally proceeds largely according to the Observations on the dry line. The described invention as such improves much the control of the paper machine, since the dry line is expressed more clearly than previously and especially its critical features are expressed unambiguously, including such features which the user cannot observe and determine at all by any other means.

The computer which belongs to the invention can, however, be used in addition to what was described, also for an immediate manipulation of the control devices (i.e. of the actuators and control devices and adjusters stated above) of the paper machine by feedback or by feedforward, such control devices include e.g. control valves 17 for control of the total flow of pulp or for control of the pressure or pulp level in the headbox, or the set value adjusters of the corresponding local control loops. In order to control the profile accross the wire, the headbox lip can be adjusted through the lip screws connected to it; these are normally affected through mechanisms which can be controlled with step, servo or other, corresponding motors 18. The computer can be connected so as to control also these, whereby it may sometimes be expedient to connect a separate control computer between the computer observing and analyzing the dry line, and the control devices or mechanical controllers mentioned above.

Figure 4:
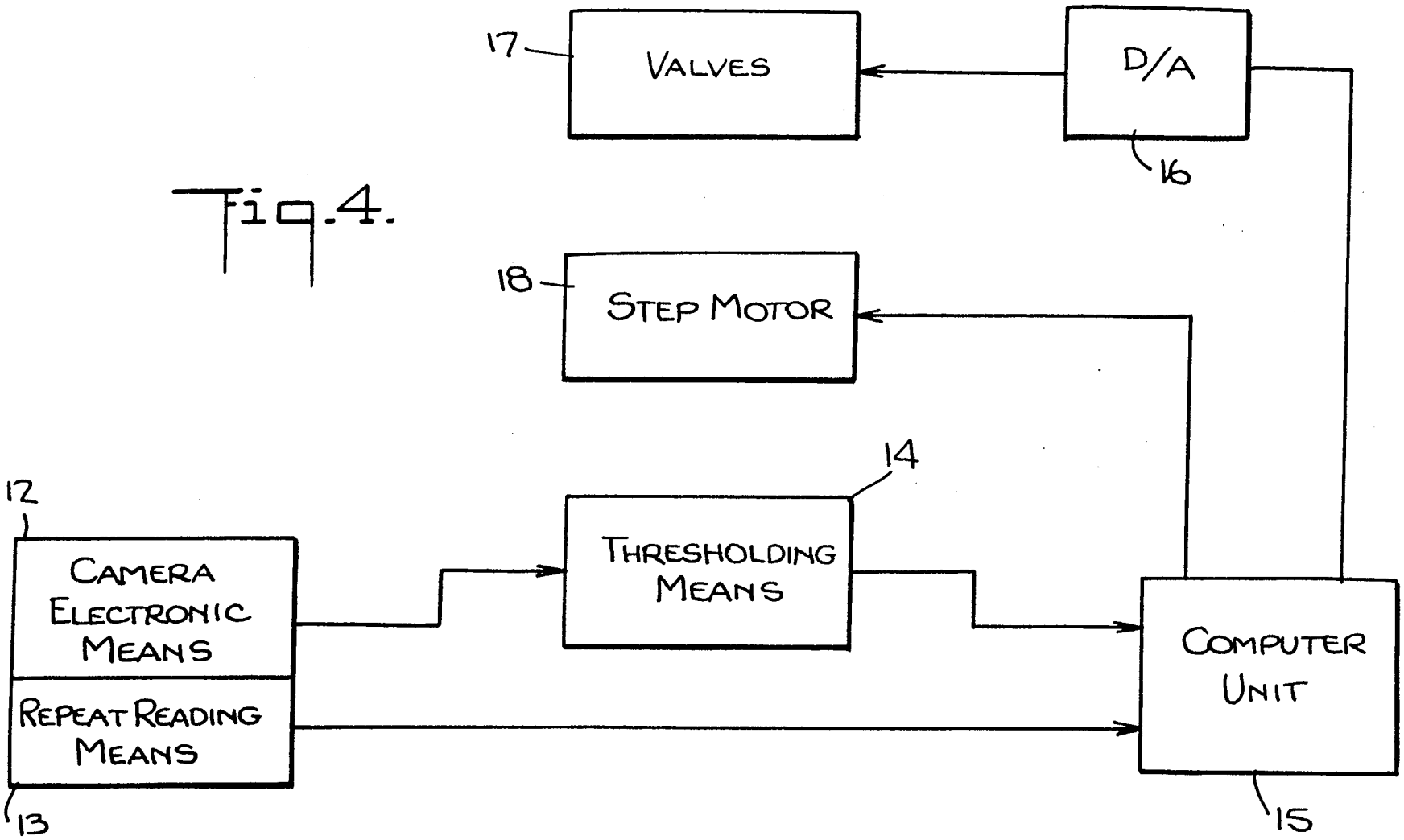
FIG. 4 represents schematically a portion of apparatus for controlling the dry line.

Referring now more particularly to FIG. 4, the camera electronic detector 12 is coupled to repeat reading means 13 for repeated reading of the electronic image signal from the detector. The electronic detector 12 is also coupled to means for thresholding and transmitting of the repeated signals. The repeat reading means 13 is coupled to a digital computer 15 capable of storing programs to determine, on the basis of information of the degree of brightness transmitted by the signals mentioned above, quantities associated with the dry line. A digital-to-analog converter is coupled to the computer and to valves 17, and the computer is coupled to step motors 18 for controlling the dry line on the basis of the quantities provided by the computer.

The methods of use of the computer for control and regulation are previously known and process computers of standard manufacture apply as such also to the tasks of analysis, alarm, control and regulation, performing them in real time with the speed required by the stated tasks. Even many microcomputers can be provided with the devices needed for connection of the camera and the control devices. The required programs of regulation and control also represent known technology and many such programs belong to the standard program supply of process computers. They can be tuned for the described tasks e.g. by experimentation, starting from cautious initial values of the tuning parameters. The automatic control of the dry line implemented in this manner essentially improves the quality of the paper by decreasing its disturbance content especially with regard to the moisture, and makes the use of the paper machine easier.

I claim:

1. A method of controlling a dry line in a Fourdrinier paper machine on the basis of differing optical properties of the parts of the pulp web preceding and following the dry line, comprising: illuminating a wire with the pulp web at such a small angle with regard to its plane that when observing the pulp web from above, the direction of observing substantially deviates from the directions of mirror reflections from a surface of the pulp web, observing the pulp web in such a manner that the pulp web part preceding the dry line is found darker than the pulp web part following the dry line with an optoelectric camera forming a two-dimensional image of the web and material on it, thresholding and supplying the repeatedly outgoing electric image signal from the camera to a digital computer programmed to distinguish from each other such parts of the wire preceding and following, respectively the dry line, on the basis of information of the degree of brightness transmitted by said signal, and to determine the position of the dry line in a longitudinal direction of the paper machine having a wire moving in a longitudinal direction and the web, for different values of a transversal coordinate, and effecting control actions based upon the determined dry line position.

2. A method according to claim 1, which includes programming the computer to determine a stated position and over- and undershoots of the dry line from its normal range and to launch at least one of alarm and control actions with respect to said over- and undershoots.

3. A method according to claim 1, in which the control actions include controlling of a headbox lip of the paper machine.

4. A method according to claim 1, which includes programming the computer to determine also the average inclination of the dry line with regard to at least one of a transversal direction, its variance, peaks and curvature and other quantities which express its form.

5. In a Fourdrinier paper machine having a wire moving in a longitudinal direction, an apparatus for controlling a dry line in the Fourdrinier paper machine on the basis of differing optical properties of parts of the pulp web preceding and following the dry line, comprising at least one light source for illuminating a wire with the pulp web thereon, the at least one light source being installed at the sides of a wire above its plane, in order to illuminate the wire with the pulp web at such a small angle that when observing the pulp web from above, the direction of observing substantially deviates from the direction of mirror reflections from a surface of the pulp web, the apparatus further comprising an opto-electric camera which forms an optical two-dimensional image of the pulp web on a plane of the opto-electric camera, in a direction which deviates from the directions of mirror reflections from pulp web on the wire and the apparatus being structured and arranged so that the pulp web part preceeding the dry line is found darker than the web part following the dry line, means for repeated reading of the electronic image signal from the camera, means for thresholding and transmitting of repeated signals, and a digital computer capable of storing programs to determine, on the basis of information of the degree of brightness transmitted by the signals mentioned above, quantities associated with the dry line, and control means for controlling the dry line on the basis of the quantities provided by the computer.

6. An apparatus according to claim 5, in which the control means is connected to the computer so as to effect automatic control of the dry line.

7. An apparatus according to claim 5, in which said at least one light source comprises two light sources positioned symmetrically on each side of the wire and in which said camera is positioned vertically above the center line of the wire.

8. An apparatus according to claim 5, in which the control means includes means for controlling a headbox lip of the paper machine.

* * * * *